US005423448A

United States Patent [19]

Pedigo

[11] Patent Number: 5,423,448

[45] Date of Patent: Jun. 13, 1995

[54] DUMPSTER-TYPE CYLINDRICAL TRASH CONTAINER

[75] Inventor: Larry E. Pedigo, Lake Mary, Fla.

[73] Assignee: Modern Welding Company, Inc., Owensboro, Ky.

[21] Appl. No.: 155,567

[22] Filed: Nov. 22, 1993

[51] Int. Cl.[6] ..... B65D 1/16

[52] U.S. Cl. ..... 220/345; 220/908; 220/343

[58] Field of Search ..... 220/908, 909, 343, 334, 220/345, 675

[56] References Cited

U.S. PATENT DOCUMENTS

| | | | |
|---|---|---|---|
| D. 274,664 | 7/1984 | Hobbs et al. | D34/3 |
| D. 274,665 | 7/1984 | Hobbs et al. | D34/3 |
| D. 276,666 | 7/1984 | Hobbs et al. | D34/3 |
| 2,864,526 | 12/1958 | Buss | 220/345 |
| 3,138,275 | 6/1964 | Dempster et al. | 214/302 |
| 3,823,972 | 7/1974 | Ramer | 294/73 |
| 3,987,829 | 10/1976 | Leone | 220/675 |
| 4,151,928 | 5/1979 | Fagliano et al. | 220/908 |
| 4,158,424 | 6/1979 | Carmack | 220/908 |
| 4,213,539 | 7/1980 | Reuter | 220/343 |
| 4,335,828 | 6/1982 | Robinson et al. | 220/908 |
| 4,407,427 | 10/1983 | Reuter | 220/908 |
| 4,445,623 | 5/1984 | Kolling et al. | 220/343 |
| 4,726,616 | 2/1988 | Schmidt | 294/68.2 |
| 4,844,282 | 7/1989 | Coff | 220/1 |
| 5,118,000 | 6/1992 | Howell et al. | 220/908 |

*Primary Examiner*—Stephen J. Castellano

[57] ABSTRACT

A cylindrical trash container is configured for lifting and emptying by a conventional trash removal vehicle having a lift assembly. The container has lifting sleeves and bumpers for guiding lift forks into the sleeves and for holding the container body away from the lifting assembly preventing damage to the container. The container uses multiple interchangeable lid portions for ease of access to the container opening and for ease of replacement lid portions. Contoured rib sections are provided on the lid for strength and convenience in storage and shipping. The container is dimensioned for fabricating efficient containment capacity while maintaining attention to human factors. A reinforced flanged bottom section provides efficient replacement.

16 Claims, 3 Drawing Sheets

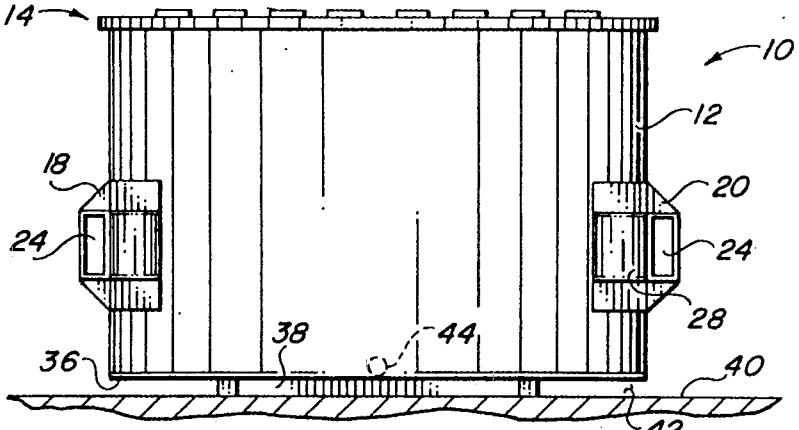
FIG. 2
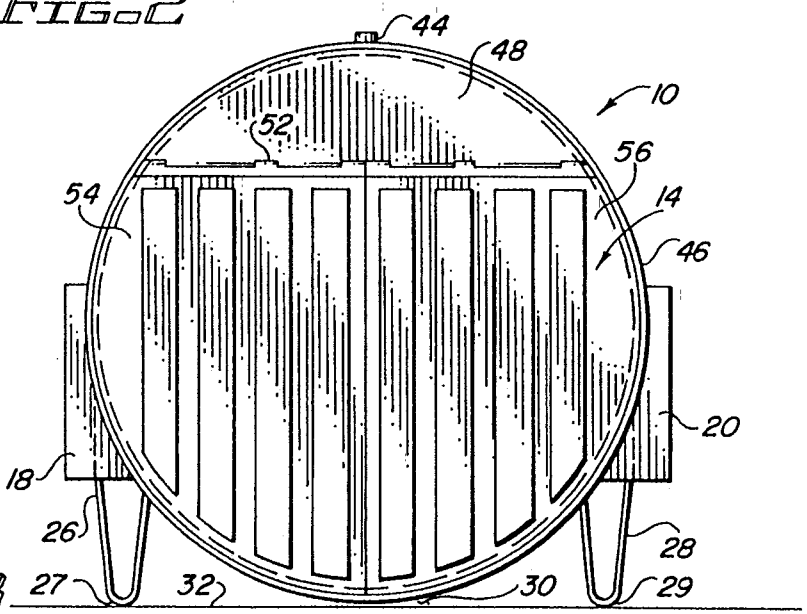
FIG. 1
FIG. 3
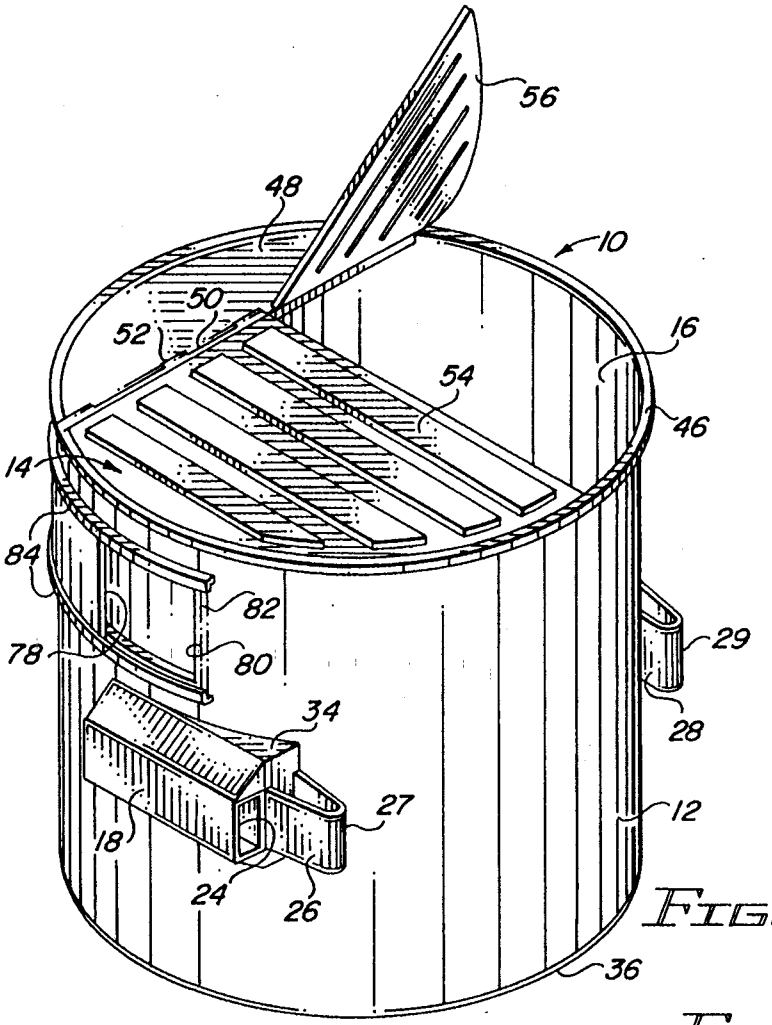

DUMPSTER-TYPE CYLINDRICAL TRASH CONTAINER

BACKGROUND OF INVENTION

1. Field of Invention

The invention relates generally to refuse containers, and more particularly to a dumping type container.

2. Background Art

Various type refuse containers are known. In particular, a dumping styled container well known to the trash removal industry provides a pair of opposed sleeves affixed to the container for communicating with lift fork assemblies. Such assemblies are provided on refuse removal vehicles for lifting the container up and over to an inverted position for the purpose of dumping contents of the container into the vehicle truck bed for removal to an appropriate dump site. As is pointed out in U.S. Pat. No. 4,726,616 issued to Phillip M. Schmidt on Feb. 23, 1988, typical dumping styled containers have a number of disadvantages including the collection of trash in corners of rectangular shaped containers. When the container is dumped, a portion of the refuse to be removed remains in the container leading to unwanted odors and ultimately rusted out container bottoms. In addition, it is pointed out that container covers are often difficult to open and sometimes fall causing injury to the user. Liquid from the contained refuse or from rain water collecting in the bottom of the container cause the container bottom to deteriorate leading to premature failure of the container.

Schmidt '616 discloses a dumpster-type trash container having a bottom wall and lower portion of side walls formed of a heavier gauge material to eliminate the premature corrosion failures. Vertical corners are inclined to reduce the tendency for trash to stick within the container when it is inverted for dumping. Covers are provided with a latching system to retain the covers in a fully opened position to prevent accidental closure and damage to the user. Different size dumpsters are disclosed for nesting the containers for more efficient shipping.

U.S. Pat. No. 3,138,275 issued to G. R. Dempster et al. on Jun. 23, 1964 discloses a front end loader for picking up containers at the front of the a motor vehicle and dumping the contents into the body of the vehicle. It is pointed out that containers are frequently provided with double lids, with each lid hinged to the body of the container along an axis extending lengthwise on the container at the upper edge of the front or back wall with each lid covering approximately half of the top of the container. The lids are usually opened to deposit trash into the container and are often left open. When a hoisting unit or front end loader is moved into engagement with the container for picking it up for dumping, if the lid on the back wall of the container is open, it has been subject to striking the top of the cab during the lifting and dumping operation, which is objectionable both from the standpoint of damage to the vehicle and the container. Dempster '275 discloses a container with double lids wherein one of the lids is hinged with a torsion spring on the edge portion of the container toward the front end loader mechanism.

U.S. Pat. Nos. Des. 274,664 through Des. 274,666 issued to Edsel J. Hobbs et al. on Jul. 10, 1984 disclose refuse receptacles having a hollow cylindrical shaped body. Openings in the container comprise equal and uneven side walls to provide openings that are level and sloped with respect to the bottom walls of respective containers. Lifting sleeves are affixed to the receptacles as is typical in the art.

SUMMARY OF INVENTION

A container comprises a hollow cylindrical body having a peripheral side wall, a top opening and a bottom opening. A bottom wall encloses the bottom opening and is affixed to the peripheral side wall for storing material. A pair of lifting sleeves is affixed to the side wall for engaging a fork lift assembly which lifts the container to an elevated position and dumps out the material. A bumper is affixed to the body for engaging the fork lift assembly. The bumper provides a gap between the assembly and the side wall portion proximate the assembly. In the preferred embodiment of the invention, a pair of bumpers are used with each bumper affixed to the lifting sleeves. The bumpers have a rounded portion for guiding fork lift elements into the sleeves.

Further, the preferred embodiment comprises a top wall affixed to the side wall, the top wall enclosing a portion of the top opening, and a lid rotatably affixed to the top wall. The lid is dimensioned to enclose a remaining portion of the top opening for enclosing the top opening. The lid comprises a half lid section having first and second surfaces. The surfaces have a central portion and a peripheral portion. The first surface central portion has a plurality of parallel rib elements spaced from each other. The spaced elements form gaps between the rib elements. Each gap is dimensioned to be at least equal to a width of the rib element. The second surface central portion also has a plurality of parallel rib elements spaced from each other. These spaced elements form second surface gaps between the second surface rib elements. The second surface rib elements are opposing the first surface gaps and the second surface gaps are opposing the first surface rib elements. The peripheral portion of the second surface engages the peripheral side wall. A straight edge portion of the half lid section passes through the axis of the cylindrical body such that placing one half lid section straight edge against the straight edge of another half lid section causes the half lids to cooperates in forming the lid for enclosing the remaining top opening. A second lid edge has hinging means for rotatably affixing the half lid to the top wall. In the preferred embodiment, the rib elements are positioned perpendicular to the second edge.

Further in the preferred embodiment, the rib elements have sloped portions in cross-section. The sloped portions come together at an apex, wherein a locus passing through the apex of the rib elements passes proximate the body axis. The locus is parallel to the second edge. The sloped portions reinforce the lid during its placement in an open position when providing access into the container through the top opening.

The container further comprises a drain port positioned proximate the bottom wall at a location opposing the side wall portion proximate the assembly for removing liquid collected within the container. In an alternate embodiment, the container comprises an opening in the side wall for placing the material into the container. A door is slidably affixed to the side wall for movement from a first position covering the side wall opening to a second position away from the opening when depositing material into the container. The cover is positioned for moving into the first position when the container is tilted by the lift assembly for dumping the material.

The container in the preferred embodiment further comprises foot elements reinforcing the bottom wall which are aligned parallel to a line passing through the sleeves for facilitating tilting of the container. The preferred container is formed from ten gauge steel and comprises a bottom wall having a flanged edge for removably affixing the bottom wall to the cylindrical side wall. In addition, to accommodate lifting of the container, a hooking means is affixed to the bottom wall for hooking the container for hoisting and relocating.

It is an object of the invention to provide a trash container useful with a trash removal vehicle having a fork lift assembly wherein the lift assembly can fully empty material stored in the container without damage to the container. It is further an object of the invention to provide a container lid that facilitates its use while providing the strength needed to support storage and dumping operations typical of track containers. It is yet another object of the invention to provide a multiple lid with lid sections that can be used interchangeably in multiple positions on the container, the lids having a construction that facilitated shipping.

It is an object of the invention to provide a container that can be fabricated from more readily available and economic sheet mill steel stock rather than plate mill stock. It is further an object of the invention to provide a container dimensioned to facilitate ease of access for users while providing sufficient storage capacity to meet economic trash removal schedules. It is further an objective to make the replacement of lids and container bottoms economically acceptable to users who heretofore have had to replace entire containers.

BRIEF DESCRIPTION OF DRAWINGS

A preferred embodiment of the invention as well as alternate embodiments are described by way of example with reference to the accompanying drawings in which:

FIG. 1 is a perspective view of the invention illustrating a cylindrical container having two interchangeable half lids;

FIG. 2 is a front view of the invention illustrating a lifting sleeve pair arranged for cooperation with a trash removal vehicle lifting assembly;

FIG. 3 is a top view of the invention illustrating the lid in a closed position with a drain port affixed in a rear wall portion of the container;

DETAILED DESCRIPTION OF PREFERRED EMBODIMENT

Figure 4:
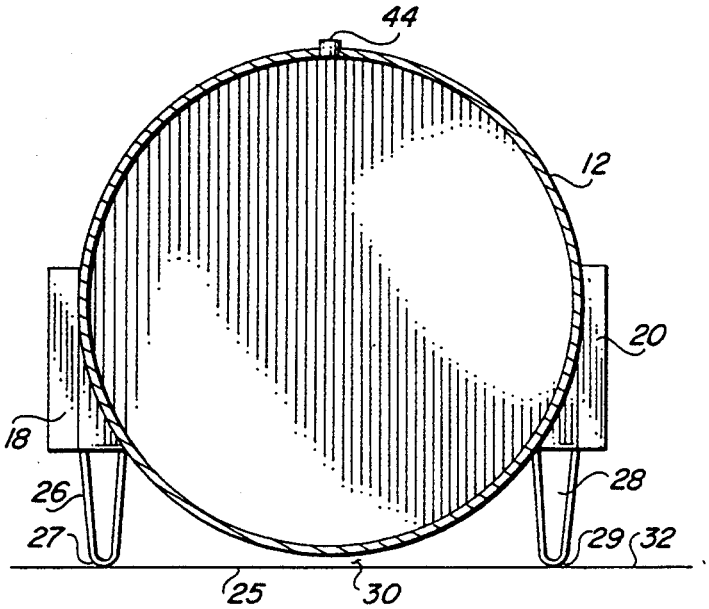
FIG. 4 is a cross-sectional view of the container in a plane perpendicular to the axis of the container passing through the lifting sleeves illustrating bumpers dimensioned to form a gap between the vehicle lift assembly and the container front wall portion.

With reference to the drawings, the container 10 for storing discarded materials and waste comprises a hollow cylindrical body 12 in the preferred embodiment of the invention. With reference to FIGS. 1–3, a lid 14 is dimensioned to cover an top opening 16 through which materials to be stored are deposited. In addition, the stored materials such as trash or recyclable materials are typically removed from the container 10 by lifting and tilting the container 10 using a fork lift assembly (not shown) of a trash removal vehicle. A pair of lift sleeves 18 and 20, is affixed to container side walls 22 for cooperating with the fork lift assembly. Each lift sleeve channel 24 is dimensioned to receive a fork. In the preferred embodiment, bumpers 26 and 28 are affixed to the lift sleeves 18 and 20 respectively for keeping the container body 12 from making direct contact with the fork lift assembly. As will be evident from the following description, the container 10 is designed to permit discharge of the contents without manual assistance while dumping.

Figure 5A:
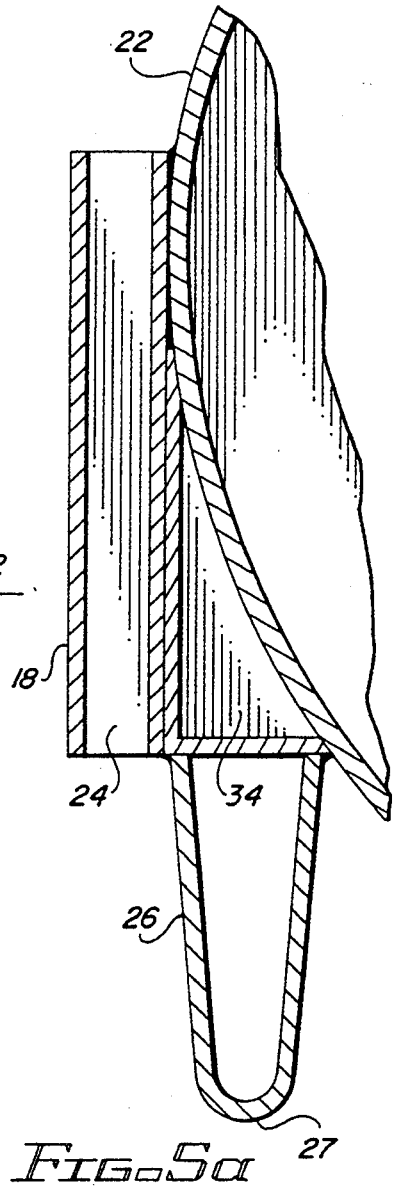
FIG. 5*a* is a partial cross-sectional view of one lifting sleeve and bumper assembly.
Figure 5B:
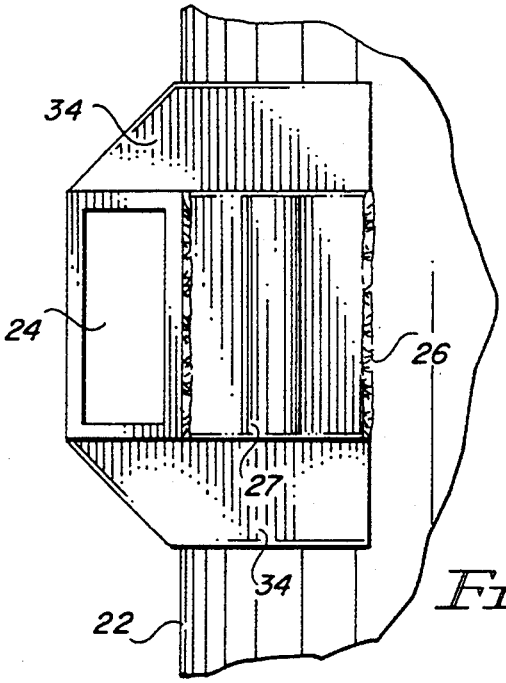
FIG. 5*b* is a partial front view of the lifting sleeve and bumper assembly of FIG. 5*a;*

With reference to FIG. 2, a front view of the container 10, the lift sleeves 18 and 20 are affixed to and outboard of the container wall 22 for positioning the channels 24 for receiving the forks of the lift assembly. In the preferred embodiment, the diameter of the container 10 is approximately 72". Such a dimension permits steel stock from sheet mill stock rather than plate mill stock. Sheet mill stock is typically available from 7 gauge to 30 gauge. Plate mill stock is typically available for 3/16" thick material and larger. With reference to FIGS. 3 and 4, top and cross-sectional views of the container 10, a gap 30 is formed by a portion 32 of the lift assembly and the container body wall 22. The lift assembly portion 32 making contact with the container 10 does so at the bumpers 26 and 28. The bumpers 26 and 28 extent sufficiently outward from the container wall 22 such that the gap 30 is maintained and the lift assembly is prevented from contacting the wall 22 and imparting possible damage thereto. The container 10 in the preferred embodiment is constructed of 10 gauge steel. The lift sleeves 18 and 20 are constructed of 10 gauge steel and provided with reinforcing ¼" gussets 34 as further illustrated in FIGS. 5*a* and 5*b*. The channel 24 is approximately 4" wide by 9" high and 27" deep for receiving typical fork lifts equipped on trash removal vehicles. The dimensions of the preferred embodiment are compatible with existing truck mounted hydraulic front end and top loading equipment. In the preferred embodiment of the invention, the bumpers 26 and 28 are fabricated from ¼" steel plates and are approximately 9" wide and 15" long. All weld seams are continuously welded to provide a complete water tight container.

Again with reference to FIG. 2, a circular bottom wall 36 is continuously welded to the side wall 22 to form a water tight seal. In the preferred embodiment, the bottom wall 36 has a flange (not shown) along its periphery for providing easier attachment to the side wall 22 especially during replacement of the bottom wall 36 after an original bottom rusts and is to be replaced. As described earlier, 10 gauge steel is used for the walls 36 and 22. The use of 12 gauge steel is typical in the industry but is well known to rust out early in the life of a container. In addition to the heavier gauge steel used, the bottom wall 36 is reinforced with foot elements 38. In the preferred embodiment, two such element 38 are used. The foot element 38 is an elongated rectangular channel affixed to the outside surface of the bottom wall 36 so as it raise the bottom wall 36 above a surface 40 upon which it is resting. The thickness of each foot element 38 is sufficient to provide a separation 42 between the surface 40 and the bottom wall 36 such that the bottom wall 36 does not contact the surface 40 during the lifting and tilting of the container 10 by the lift assembly. In this way, the container walls 22 and 36 are further protected from damage.

With further reference to FIGS. 2–4, a drain port 44 is provided in the side wall 22 opposite the lift assembly side of the container 10. In this way, any water or liquid collected in the watertight container 10 can be drained by tilting the container 10 away from the lift assembly prior to dumping the contents of the container 10. Not shown in the drawings is a hook affixed to the bottom wall 36 proximate the axis of the container 10. The hook serves as a way of affixing a hoist to the container 10 in the event it falls from the fork lift in an inverted position within the vehicle, a position typically cumbersome for handling containers.

The lid 14 provides features supportive of the objects of the invention. Again with reference to FIG. 1, the preferred embodiment of the container 10 comprises a stiffening ring 46 affixed along the perimeter of the container top opening 16. The opening 16 is partially enclosed by a top wall 48 affixed to the side wall 22. The top wall 48 has a straight edge 50 forming a chord with the circular opening 16. Hinges 52 are affixed to the edge 50 for rotatably affixing the lid 14. In the preferred embodiment, the lid 14 comprises two semicircular sections, a left half lid section 54 and a right half lid section 56. Each lid section 54 and 56 has a straight edge 60 aligning with the top wall straight edge 50. The lid sections 54 and 56 are rotatably affixed to the hinges 52 on the top wall straight edge 50. The straight edge 50 is aligned parallel to the lift assembly such that the lid 14 opens unassisted during the dumping process. The edge 50 is thus parallel to a plane 25 passing through edges 27 and 29 respectively of the bumpers 26 and 28 which edges 27 and 29 contact the lift assembly.

Figure 6D:
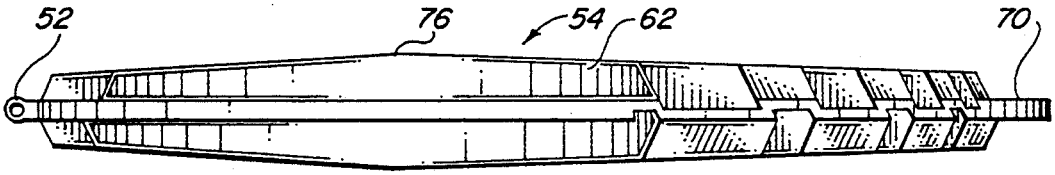
FIG. 6*d* is a side view of the lid used in the preferred embodiment of the invention illustrating the contour and hinge assembly.
Figure 6A:
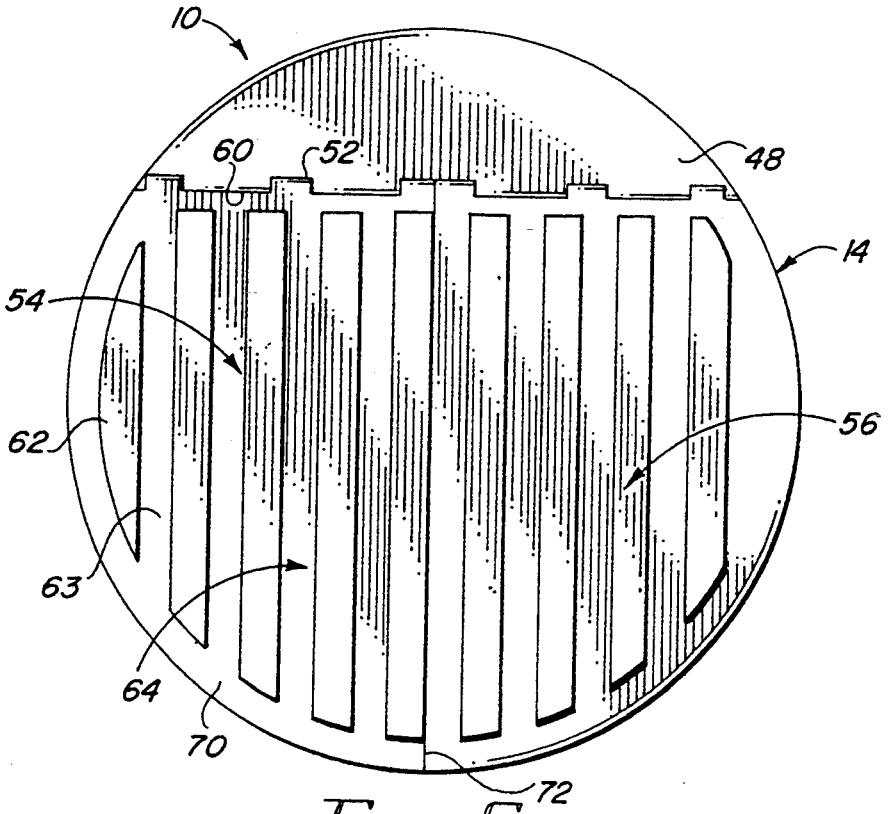
FIG. 6*a* is a partial top view of a lid used in the preferred embodiment of the cylindrical container configured with two half lid sections.
Figure 6B:
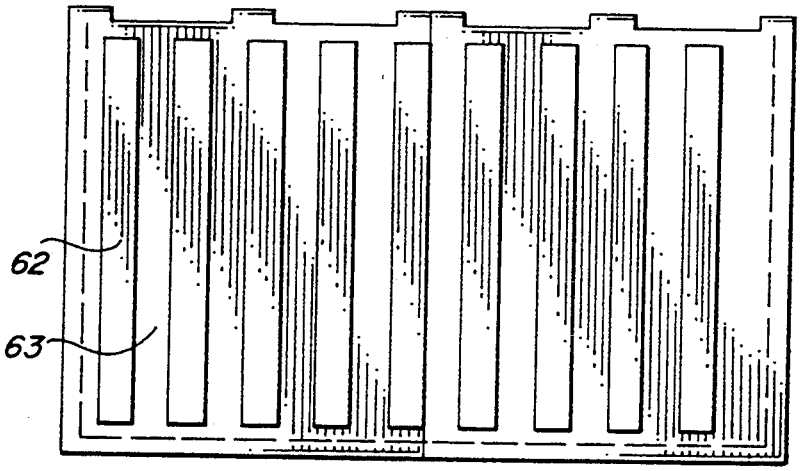
FIG. 6*b* is a partial top view of a lid configured in an alternate embodiment for use with a rectangular shaped container.
Figure 6C:
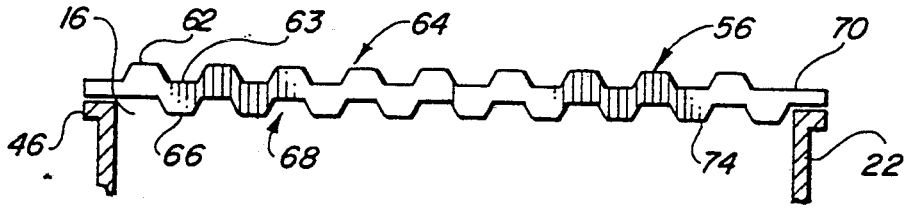
FIG. 6*c* is a partial cross-sectional view of the lid illustrating the corporation of first and second surface ribs and gaps cooperating to cover the container opening.

With reference to FIGS. 6*a*–6*c*, the lid 14 is formed with a plurality of ribs 62. Although the preferred embodiment, a cylindrical shape container 10 is described, as illustrated in FIG. 6*b*, a lid 15 of the invention described is suitable for a rectangular shape container. By way of example, the preferred embodiment will be used to further describe the lid 15. Again with reference to FIGS. 6*a* and 6*c*, a top view of the container 10, the left lid section 54 has nine ribs 62 on an outside surface 64 of the left lid section 54. To further describe, the ribs 62 of the left lid section outside surface 64 are numbered 1, 3, 5, 7, and 9. Ribs 66 are formed on an inside surface 68 of the left lid section 54. These ribs 66 are numbered 2, 4, 6, and 8. Ribs 62 are separated by gaps 63. Ribs 66 are separated by gaps 67. The ribs 62 are arranged such that the ribs 62 oppose the gaps 67 and the ribs 66 oppose the gaps 63. A lid peripheral portion 70 is dimensioned to cooperate with the opening 16 for sealing the lid 14 against the side wall 22 at the opening 14. The left lid section 54 in the preferred embodiment represents half of the lid 14. The left lid section 54 has another straight edge 72 which passes through the center of the opening 16. With such an arrangement, the left lid section 54 can be turned over and perform as the right lid section 56 by virtue of the described lid construction. In other words, the outside surface 64 of the left lid section 54 will become the inside surface of the right lid section 56. By way of the example described, ribs 62 numbered 1, 3, 5, 7, and 9 will be on an inside surface 74 of the right lid section 56 and ribs 66 numbered 2, 4, 6, and 8 will be on an outside surface 76 of the left lid section 56. As evident from the rectangular lid 15 illustrated in FIG. 6*b*, the same will hold true. The lid sections 54 and 56 are interchangeable. Half lid sections 54 and 56 have been described, however, it is evident that partial sections of any fraction can be implemented. As a practical matter, large rectangular containers will clearly benefit from such an arrangement.

With reference to FIG. 6*d*, a side view of the left lid section 54 of the preferred embodiment is illustrated showing the hinge 52 and structure features described. Another feature of the lid 14 is its contour having an apex 76 which passes through the axis of the container body 12. Such a contour provides added strength to the lid 14 and allows rain falling on the lid 14 to more easily flow off. The lid 14 of the preferred embodiment is formed from molded plastic to be sufficiently light to encourage manual use. The strength is sufficient to permit the lid 14 to be lifted and rotated away from the opening 16 and placed onto the top wall 48 for storing the lid 14 in an open position without deforming the lid shape. Each lid section is rotationally molded in one piece from high density cross-linked polyethylene (Marlex CL-100 or equivalent). Carbon black material color and a material lid wall thickness (not shown) of approximately $\frac{1}{8}''$ for single walled lids is used. Double walled lids have a minimum of a 1/16″ wall thickness. The hinges 52 of the preferred embodiment comprises a $\frac{1}{2}''$ diameter round hinge rod (not shown).

The preferred embodiment of the invention is marketed in a variety of sizes. The diameter of the container body 12 is such that a container be holding three cubic yards is approximately three feet high. A container 10 holding four cubic yards is approximately four feet high, five cubic yards at five feet high, and six cubic yards at six feet high. An additional feature of the container 10 as illustrated in FIG. 1, includes the use of a side wall door 78. A closed position 80 over a side wall portal 82 is toward the front or bumper side of the container such that the lifting of the container causes the door 78 to slide into the closed position 82 if it were no so prior to the dumping. The door 78 rides on tracks 84 and is free running on the tracks 84 until the door 78 reaches door stops (not shown) preventing the door 78 from leaving the tracks 84. The door 78 has a handle and locking mechanism (not shown) for securing access to the contents through the door 78. In the preferred embodiment, the side doors 78 are fabricated from steel and from polyethylene in an alternate embodiment.

While specific embodiments of the invention have been described in detail herein above, it is to be understood that various modifications may be made from the specific details described herein without departing from the spirit and scope of the invention as set forth in the appended claims.

In the foregoing description, certain terms have been used for brevity, clearness and understanding, but no unnecessary limitations are to be implied therefrom beyond the requirements of the prior art. Such words are used for descriptive purposes herein and are intended to be broadly construed. Moreover, the embodiments of the apparatus illustrated and described herein are by way of example, and the scope of the invention is not limited to the exact details of construction.

What is claimed is:

1. A container comprising:

a hollow cylindrical body having a peripheral side wall, the body having a top opening and a bottom opening;

a bottom wall enclosing the bottom opening, the bottom wall affixed to the peripheral side wall for cooperating to store material;

a pair of lifting sleeves affixed to the side wall for cooperating in engaging a fork lift assembly for lifting the container to an elevated position for dumping the material;

a bumper affixed to the body for engaging the assembly, the bumper providing a gap between the assembly and the side wall portion proximate the assembly; and a door slidably affixed to the side wall for movement from a first position covering an opening in the side wall to a second position away from the opening, the side wall opening dimensioned for placing the material into the container, the cover positioned for moving into the first position when the container is titled by the lift assembly for dumping the material.

2. A container comprising:

a hollow cylindrical body having a peripheral side wall, the body having a top opening and a bottom opening;

a bottom wall enclosing the bottom opening, the bottom wall affixed to the peripheral side wall for storing material;

a pair of lifting sleeves affixed to the side wall for cooperating in engaging a fork lift assembly for lifting the container to an elevated position for dumping the material; and a pair of bumpers, each bumper affixed to each of the lifting sleeves, the bumpers extending tangentially outward from the side wall for engaging the assembly, the bumpers extending so as to form a gap between the assembly and the side wall portion proximate the assembly, the bumpers having rounded end portions for guiding fork lift elements into the sleeves;

a top wall extending over a portion of the top opening, the top wall affixed to the side wall, the top wall having a straight edge forming a chord with the top opening;

a lid rotatably affixed to the top wall edge, the lid dimensioned for enclosing a remaining portion of the top opening for cooperating with the top wall for enclosing the top opening; and a door slidably affixed to the side wall for movement from a first position covering an opening in the side wall to a second position away from the opening, the side wall opening dimensioned for placing the material into the container, the cover positioned for moving into the first position when the container is tilted by the lift assembly for dumping the material.

3. A container comprising:

a hollow cylindrical body having a peripheral side wall, the body having a top opening and a bottom opening;

a bottom wall enclosing the bottom opening, the bottom wall affixed to the peripheral side wall for cooperating to store material;

a pair of lifting sleeves affixed to the side wall for cooperating in engaging a fork lift assembly for lifting the container to an elevated position for dumping the material;

a bumper affixed to the body for engaging the assembly, the bumper providing a gap between the assembly and the side wall portion proximate the assembly;

a top wall affixed to the side wall, the top wall enclosing a portion of the top opening; and a lid rotatably affixed to the top wall, the lid dimensioned for enclosing a remaining portion of the top opening for cooperating with the top wall for enclosing the top opening, the lid comprising half lid sections having first and second surfaces, the surfaces having a central portion and a peripheral portion, the first surface central portion having a plurality of parallel rib elements spaced from each other, the spaced elements forming gaps between the rib elements wherein the gap is dimensioned to be at least equal to a width of the rib element, the second surface central portion having a plurality of parallel rib elements spaced from each other, the spaced elements forming a second surface gap between the second surface rib elements wherein the second surface rib elements are opposing the first surface gaps and the second surface gaps are opposing the first surface rib elements, the peripheral portion of the second surface for engaging the peripheral side wall, each half lid section further having a straight edge, the straight edge passing through the axis of the cylindrical body, wherein placing one half lid section straight edge against the straight edge of another half lid section causes the half lid sections to cooperate in forming the lid for enclosing the remaining top opening; and each lid section further having a second lid edge with means for hingably affixing each half lid section to the top wall, the rib elements positioned perpendicular to the second edge.

4. The container as recited in claim 3, wherein the bumper comprises a pair of bumpers, each of the pair affixed to the lifting sleeves, the bumper having a rounded portion for guiding fork lift elements into the sleeves.

5. The container as recited in claim 3, wherein the rib elements have sloped portions in cross-section, the sloped portions coming together at an apex, wherein a locus passing through the apex of the rib elements passes proximate the body axis, the locus parallel to the second edge, the sloped portions for reinforcing the lid during its placement in an open position for providing access into the container through the top opening.

6. The container as recited in claim 3, wherein the side wall further comprises a drain port positioned proximate the bottom wall at a location opposing the side wall portion proximate the assembly for removing liquid collected within the container.

7. The container as recited in claim 3, further comprising foot elements affixed to the bottom wall for reinforcing the bottom wall, the foot elements aligned parallel to a line passing through the sleeves.

8. The container as recited in claim 3 wherein the walls are formed from ten gauge steel.

9. The container as recited in claim 3 wherein the bottom wall comprises a flanged edge for removably affixing the bottom wall to the cylindrical side wall.

10. A container comprising:

a hollow cylindrical body having a peripheral side wall, the body having a top opening and a bottom opening;

a bottom wall enclosing the bottom opening, the bottom wall affixed to the peripheral side wall for storing material;

a pair of lifting sleeves affixed to the side wall for cooperating in engaging a fork lift assembly for lifting the container to an elevated position for dumping the material; and a pair of bumpers, each bumper affixed to each of the lifting sleeves, the bumpers extending tangentially outward from the side wall for engaging the assembly, the bumpers extending so as to form a gap between the assembly and the side wall portion proximate the assembly, the bumpers having rounded end portions for guiding fork lift elements into the sleeves;

a top wall extending over a portion of the top opening, the top wall affixed to the side wall, the top wall having a straight edge forming a chord with the top opening; and a lid rotatably affixed to the top wall edge, the lid dimensioned for enclosing a remaining portion of the top opening for cooperating with the top wall for enclosing the top opening, the lid comprising half lid sections having first and second surfaces, the surfaces having a central portion and a peripheral portion, the first surface central portion having a plurality of parallel rib elements spaced from each other, the spaced elements forming gaps between the rib elements wherein the gap is dimensioned to be at least equal to a width of the rib element, the second surface central portion having a plurality of parallel rib elements spaced from each other, the spaced elements forming a second surface gap between the second surface rib elements wherein the second surface rib elements are opposing the first surface gaps and the second surface gads are opposing the first surface rib elements, the peripheral portion of the second surface for engaging the peripheral side wall, each lid section further having a straight edge the straight edge passing through the axis of the cylindrical body wherein placing one half lid section straight edge against the straight edge of another half lid section causes the half lids to cooperate in forming the lid for enclosing the remaining top opening, each section further having a second lid edge with means for hingably affixing each half lid section to the top wall, wherein the rib elements are positioned perpendicular to the second edge.

11. The container as recited in claim 10, wherein the rib elements have sloped portions in cross-section, the sloped portions coming together at an apex, wherein a locus passing through the apex of the rib elements passes proximate the body axis, the locus parallel to the second edge, the sloped portions for reinforcing the lid during its placement in an open position for providing access into the container through the top opening.

12. The container as recited in claim 10, wherein the side wall further comprises a drain port positioned proximate the bottom wall at a location opposing the side wall portion proximate the assembly for removing liquid collected within the container.

13. The container as recited in claim 10, further comprising foot elements affixed to the bottom wall for reinforcing the bottom wall, the foot elements aligned parallel to a line passing through the sleeves for raising the bottom wall above a ground contacting position.

14. The container as recited in claim 10, wherein the bottom wall comprises a flanged edge for removably affixing the bottom wall to the cylindrical side wall.

15. The container as recited in claim 10, wherein the bottom wall and peripheral side wall are dimensioned so as to be cut from sheet mill stock.

16. The container as recited in claim 10, wherein the diameter of the cylindrical body is approximately $70\frac{3}{8}''$ for providing a container having an integer value volume measurement in cubic yards represented by the integer value corresponding to a body linear height measurement in feet.

* * * * *